US008627779B2

(12) United States Patent
Witte

(10) Patent No.: US 8,627,779 B2
(45) **Date of Patent: *Jan. 14, 2014**

(54) JACK PLATE FOR AN OUTBOARD MOTOR

(76) Inventor: Alan D. Witte, St. Cloud, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/614,407

(22) Filed: Sep. 13, 2012

(65) Prior Publication Data

US 2013/0153743 A1 Jun. 20, 2013

Related U.S. Application Data

(63) Continuation of application No. 12/240,451, filed on Sep. 29, 2008, now Pat. No. 8,267,025.

(60) Provisional application No. 60/976,243, filed on Sep. 28, 2007.

(51) Int. Cl.
*B63H 20/08* (2006.01)

(52) U.S. Cl.
USPC ..... 114/53; 248/641

(58) Field of Classification Search
USPC ..... 248/640–643; 384/40–42; 440/53–60, 440/61 R, 62–65
See application file for complete search history.

(56) References Cited

U.S. PATENT DOCUMENTS 4,232,627 A 11/1980 Glenn et al.
4,907,993 A 3/1990 Thompson
5,782,662 A 7/1998 Icenogle
5,938,340 A 8/1999 Brodersen
6,890,227 B1 5/2005 Alby et al.
7,013,825 B1 3/2006 D'Alessandro
7,311,569 B2 12/2007 Mullen et al.
7,416,459 B1 8/2008 Pelini
2007/0221113 A1 9/2007 Detwiler et al.

OTHER PUBLICATIONS

Powrtran—High Tech Accessories for Better Boat Performance sales brochure, 1994, 12 pages.

Framework for a jack plate for an outboard motor, prior to 2006, 1 page.

Application and File History of U.S. Appl. No. 12/240,451, filed Sep. 28, 2008, now U.S. Patent 8,267,025, issuing Sep. 18, 2012, Inventor Alan D. Witte.

*Primary Examiner* — Edwin Swinehart
(74) *Attorney, Agent, or Firm* — Christensen Fonder P.A.

(57) ABSTRACT

A jack plate for vertically raising and lowering an outboard motor mounted on a boat. The jack plate comprises a motor lift and a jack plate mounting assembly. The jack plate mounting assembly has a transom plate and a pair of spacing brackets with jack plate rails. The motor lift has a pair of bearings that are interlocked to a lift plate. The motor lift is slidably situated within the jack plate rails. Complementary geometries of the outer side edges of the lift plate and inner edges of channels in the bearings, as well as the spacing between the jack plate rails, provide a pressure fit that secures the lift plate between the bearings once the bearings are inserted into the jack plate rails.

17 Claims, 19 Drawing Sheets

JACK PLATE FOR AN OUTBOARD MOTOR

RELATED APPLICATIONS

This application is a continuation of U.S. application Ser. No. 12/240,451, filed Sep. 29, 2008, now U.S. Pat. No. 8,267,025, issued Sep. 18, 2012, which application claims the benefit of U.S. Provisional Application No. 60/976,243 filed Sep. 28, 2007, which applications are fully incorporated herein by reference.

FIELD OF THE INVENTION

The present invention relates to a mechanism for mounting outboard motors onto boats. More specifically, the present invention relates to a jack plate for vertically adjusting the trim and/or height of an outboard motor.

BACKGROUND OF THE INVENTION

During operation of a boat powered by an outboard motor, it is often desirable to raise or lower the motor. For example, when operating a boat in shallow water or removing a boat from the water with a submersible boat trailer, it is often necessary to raise the motor so that the propeller and rudder are not damaged by the bottom of the body of water. In other instances, it may be desirable to raise the motor while operating the boat at high speeds to reduce the amount of drag created by the presence of the motor in the water.

Adjusting the trim or height of an outboard motor can be accomplished by manipulating a set of controls operably connected to a jack plate. Although meanings of the term jack plate can vary, for purposes of this application, jack plate refers to the interfacing apparatus between a boat and an accompanying outboard motor. Generally, a component of the jack plate is fixedly mounted to the transom of the boat, while another component is mounted to the outboard motor. By operating an actuator attached to the two components, the motor can be raised or lowered in relation to the transom. A number of different types of lift actuators have been incorporated into jack plates, such as, for example, hydraulic, electric, electro-mechanical, or strictly manually operated actuators.

Jack plates can accomplish raising or lowering the propeller of an outboard motor by pivoting the motor about a selected point, such as at or near the top of the transom. Pivoting an outboard motor to raise the motor, however, has several drawbacks. As the motor pivots, the angle at which the propeller displaces water changes, resulting in a decrease in the propulsive efficiency of the motor.

Because of the drawbacks associated with tilting outboard motors, jack plates have been developed that can raise or lower the entire outboard motor in a substantially vertical direction. For example, U.S. Pat. No. 5,782,662 discloses an hydraulically powered jack plate comprising opposing supports that incorporate linear bearings in which rides a slide which is capable of vertical movement. In such vertically actuating jack plates, the points where the bearings and the lift plate are joined typically bear much of the weight of the motor. As a motor is vertically lifted out of the water, the bearings bear an even greater load as the buoyant force of the water acting upon the motor is reduced. As a result, a drawback of existing vertically actuating jack plates is mechanical failure where the bearings are joined to the lift plate. A further drawback of existing jack plates is the presence of fastening members that can result in binding between the moving parts of the jack plate.

SUMMARY OF THE INVENTION

The present invention overcomes the aforementioned deficiencies by providing a jack plate with an improved motor lift. The motor lift comprises a pair of columnar bearings that receives the vertical edges of a lift plate. Each bearing defines a channel into which the vertical edges of the lift plate can be fully inserted. The vertical edges of the lift plate and the channels within the bearings define complementary geometries such that the lift plate and the bearings are interlocking. Since the channels typically do not extend the full length of the bearings, the channels are able to substantially retain the lift plate in place and reduce—if not obviate—the need to join the bearings and the lift plate with fastening members.

Each of a pair of spacing brackets defines a jack plate rail having an inner geometry that conforms to the outer geometry of a bearing. A transom plate is secured to the spacing brackets such that the jack plate railings are spaced apart at a selected distance. The transom plate and the spacing brackets may also have complementary geometries.

When the bearings are inserted into the jack plate rails, the lift plate may be pressure fit between and within the bearings. The channels within the jack plate bearings thereby inhibit lateral movement of the lift plate in relation to the bearings, while the conforming fit of the lift plate within the channels of the bearings and/or the complementary geometries of the parallel vertical edges of the lift plate and the inner channel edges of the bearing impede vertical movement of the lift plate in relation to the bearings.

The lift plate can thereby be raised and lowered vertically in relation to the spacing brackets. The complementary geometries of the lift plate and the channels of the bearings, as well as the complementary geometries of the transom plate and the spacing brackets, reduce the likelihood of mechanical failure.

In an embodiment of the present invention, a jack plate comprises a mounting assembly having first and second spacing brackets connected by a transom plate, each of the first and second spacing brackets defining parallel channels distal to the transom plate, the transom plate being mountable to a boat transom, a motor lift including a lift plate positioned intermediate first and second bearings, each bearing defining a keyed slot adapted to receive a first or second side of the lift plate, and an actuator operably connected to the mounting assembly and the motor lift. The channels are adapted to conformingly receive the first and second bearings such that the lift plate is substantially pressure fit between the first and second bearings.

In another embodiment of the present invention, a boat comprises a hull having a transom, an outboard motor, and a jack plate disposed intermediate the hull and the outboard motor. The jack plate further comprises a mounting assembly having first and second spacing brackets connected by a transom plate, each of the first and second spacing brackets defining parallel channels distal to the transom plate, the transom plate being mountable to a boat transom, a motor lift including a lift plate positioned intermediate first and second bearings, each bearing defining a keyed slot adapted to receive a first or second side of the lift plate, and an actuator operably connected to the mounting assembly and the motor lift. The semi-circular channels are adapted to conformingly receive the first and second bearings such that the lift plate is substantially pressure fit between the first and second bearings.

In further embodiments, the channels and the bearings may be substantially cylindrical. A portion of the first spacing bracket and a portion of the second spacing bracket defining parallel channels, each portion having a substantially C-shaped cross section. The first and second spacing brackets may be adapted to removably receive the transom plate in a first direction and retain the transom plate in directions perpendicular to the first direction. The keyed slot of the first or second bearing may define at least one groove and the first or second side of the lift plate may define at least one protrusion, the at least one groove being complementary to the at least one protrusion. The lift plate may substantially define plane, the at least one protrusion extending from the first or second side in a direction substantially parallel to the plane. Alternatively, the lift plate may substantially define a plane, the at least one protrusion being proximal to the first or second side and extending substantially away from the plane. The at least one protrusion may engage the at least one groove to substantially secure the lift plate to the first or second bearing. The motor lift may further include a fastening member extending through the first or second bearing and the lift plate. At least one of the first or second bearings and at least one of the first or second spacing brackets may present opposing surfaces adapted to prevent the motor lift from disengaging the first and second spacing brackets in a downward direction. The motor lift may be adapted to be attached to an outboard motor. The first and second bearings may be made of a polymer.

In yet another embodiment of the present invention, a method of mounting an outboard motor onto a boat comprises forming a motor lift by positioning a plate between first and second bearings, each bearing defining a keyed slot adapted to receive a side of the plate, inserting each of the first and second bearings into a first or second channel of a mounting assembly, attaching the mounting assembly to a transom of the boat, and attaching the outboard motor to the lift plate.

In further embodiments, the method may include operably connecting an actuator to the mounting assembly and the motor lift. The method may also include forming the mounting assembly by disposing a transom plate to each of first and second mounting brackets. The method can include attaching the mounting assembly by attaching the transom plate to the transom. The method may further include inserting each of the first and second bearings into a first or second channel of a mounting assembly presenting surfaces of the first and second bearings that oppose top surface of first and second spacing brackets defining the first and second channels, the opposing surfaces being adapted to prevent the motor lift from disengaging the first and second spacing brackets in a downward direction. The method can also include extending a fastening member through the first or second bearing and the lift plate. In addition, the first bearing may define a keyed slot having at least one groove and a first side of the lift plate defines at least one protrusion, the at least one groove being complementary to the at least one protrusion, such that the method further includes engaging the at least one groove and the at least one protrusion to substantially secure the lift plate to the first bearing.

In another embodiment of the present invention, a method of controlling the trim of a boat, the boat having an outboard motor attached to a jack plate comprising an actuator operably connected to a mounting assembly and a motor lift, the mounting assembly having first and second spacing brackets connected by a transom plate, each of the first and second spacing brackets defining parallel channels distal to the transom plate, the transom plate being mountable to a boat transom, the motor lift including a lift plate positioned intermediate first and second bearings, each bearing defining a keyed slot adapted to receive a side of the lift plate, comprises actuating the actuator, sliding the first and second bearings within the channels of the mounting brackets, and maintaining the position of the first and second bearings in substantially the same position relative to the lift plate.

In another embodiment, the method may include preventing the motor lift from disengaging the first and second spacing brackets in a downward direction.

Figure 1:
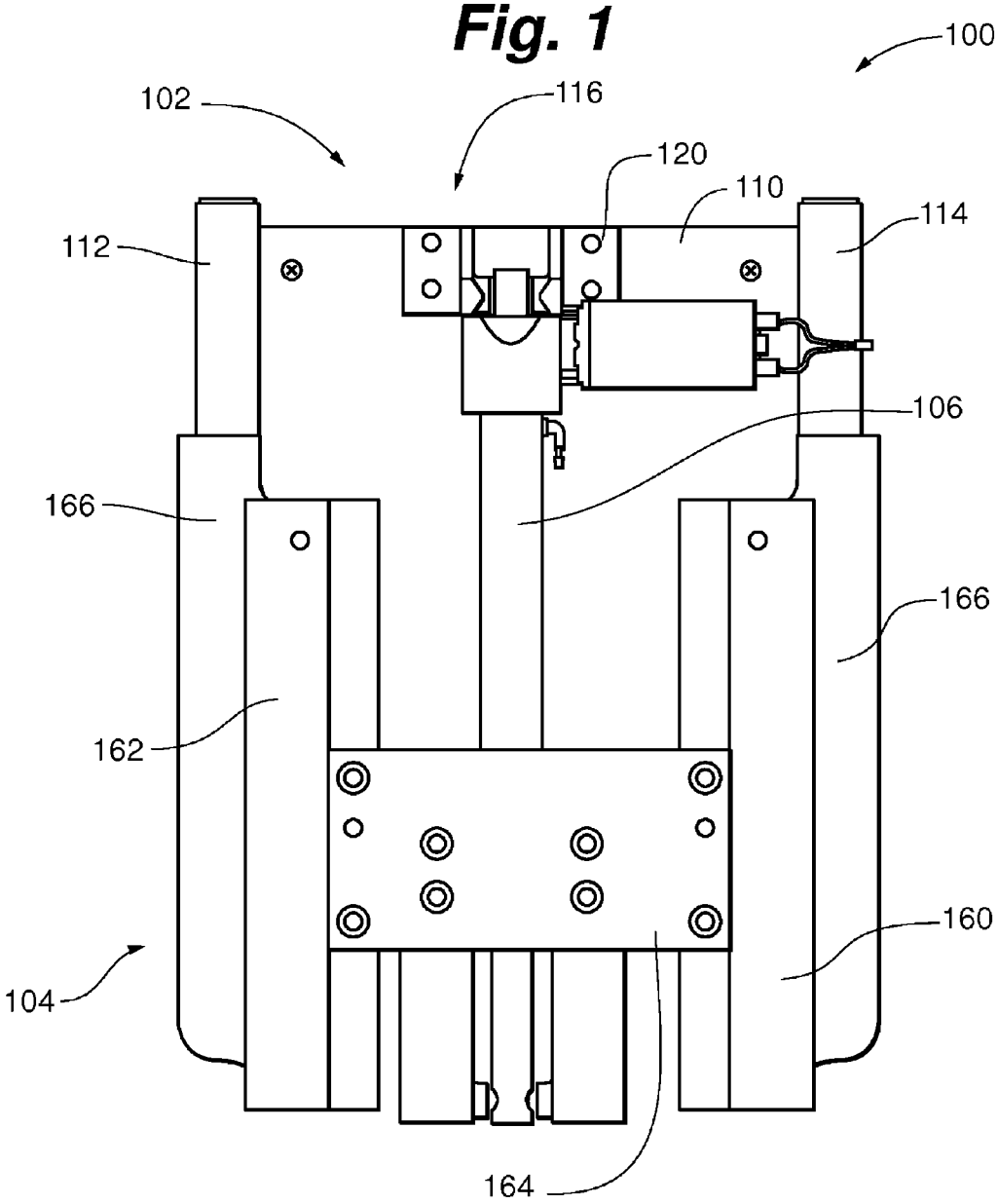
FIG. 1 is a rear view of a jack plate according to an embodiment of the present invention with an actuator.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

Figure 5:
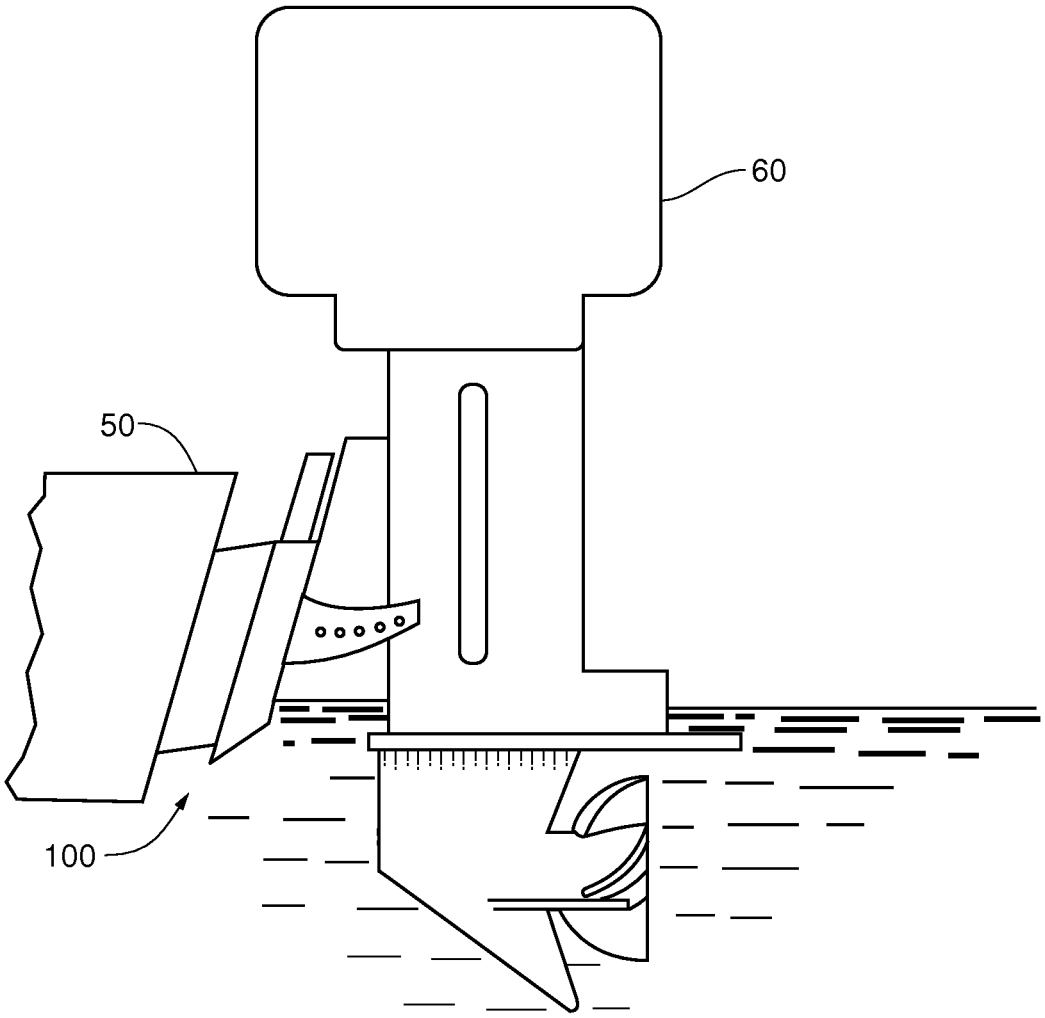
FIG. 5 is a side view of a lift plate according to an embodiment of the present invention mounted to a boat and an outboard motor.

The jack plate of the present invention can be mounted intermediate boat 50 and outboard motor 60 and is shown generally as jack plate 100 in FIG. 5. Referring to FIG. 1, jack plate 100 comprises motor lift 102 and jack plate mounting assembly 104. Jack plate 100 generally also includes actuator 106. In an embodiment, actuator 106 is an electro-mechanical ball screw actuator. In other embodiments, actuator 106 can be manual, an electrical, a mechanical or other type of actuator 106.

Motor lift 102 comprises lift plate 110 and bearings 112, 114, as depicted in FIG. 1-4. Motor lift 102 generally also includes actuator mount 116. In an embodiment, actuator mount 116 is formed from two actuator brackets 118, 120. In alternative embodiments, actuator mount 116 may be formed from a single actuator bracket or from actuator mount 116 having several actuator brackets 118, 120 and/or additional components.

Figure 6:
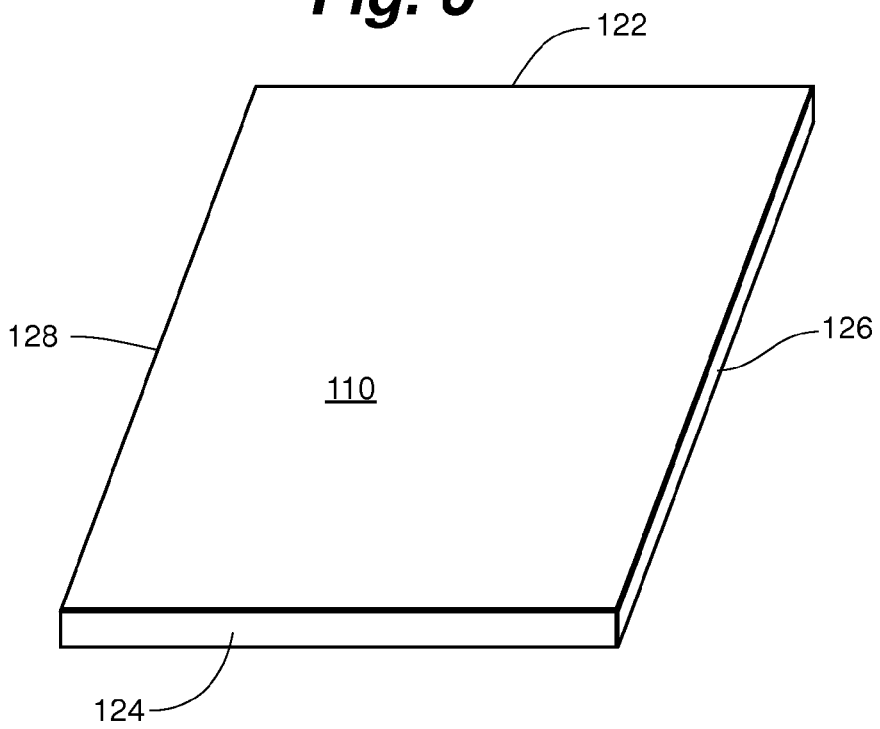
FIG. 6 is a perspective view of a lift plate according to an embodiment of the present invention.
Figure 7:
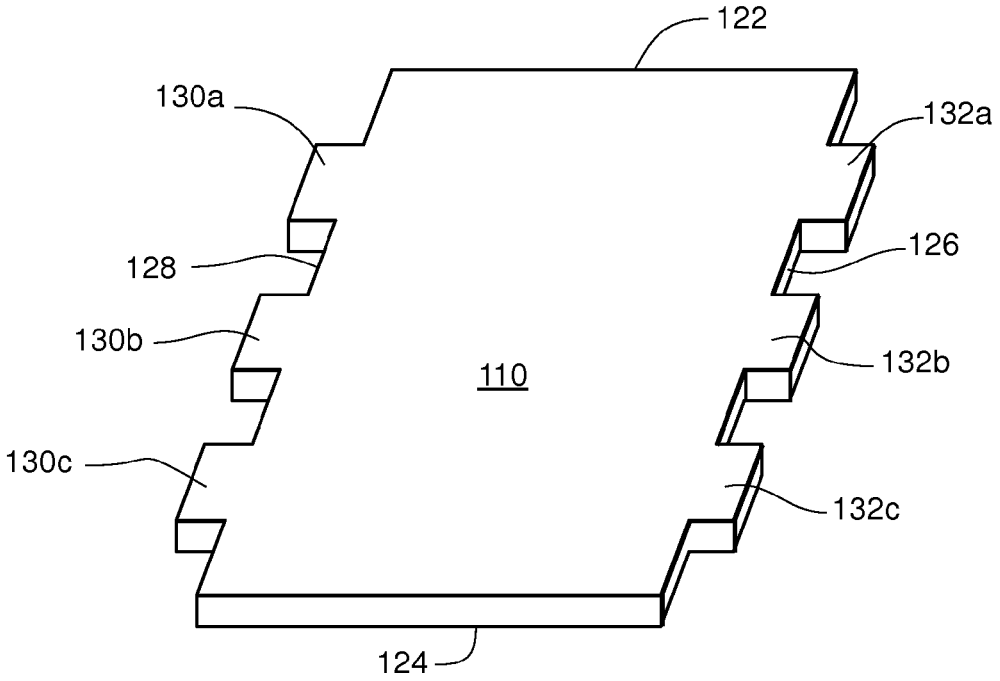
FIG. 7 is a perspective view of a lift plate according to another embodiment of the present invention.
Figure 8:
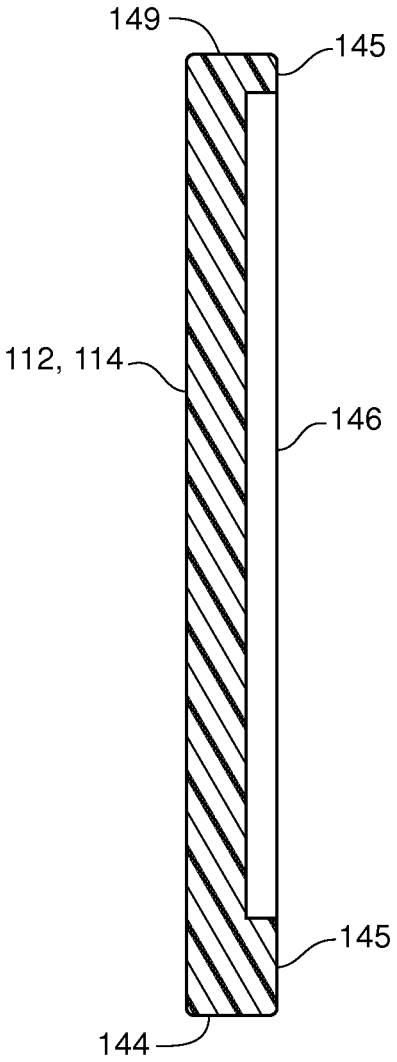
FIG. 8 is cross-sectional view of a bearing according to another embodiment of the present invention.
Figure 9:
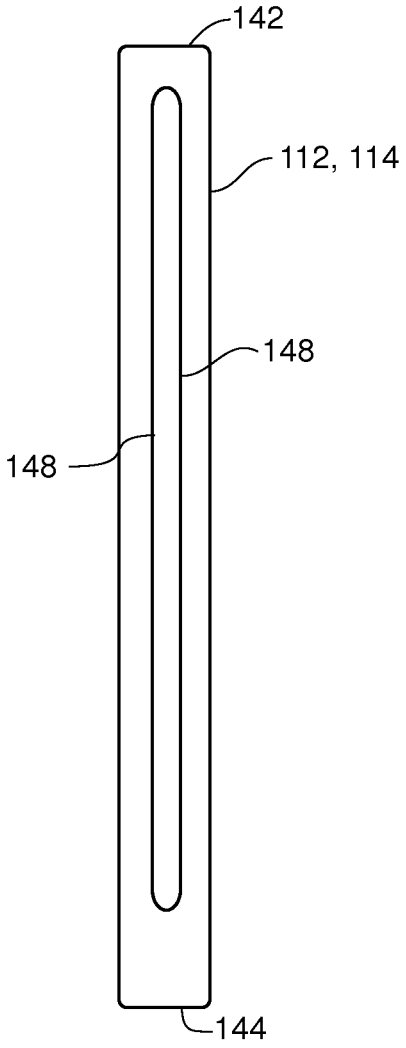
FIG. 9 is front view of a bearing according to the embodiment of the present invention depicted in FIG. 8.

Lift plate 110 has top edge 122, bottom edge 124, and side edges 126, 128. Each side edge 126, 128 may be straight, as depicted in FIG. 6, or have tabs 130*a-c*, 132*a-c*, as depicted in FIG. 7. In an embodiment, side edge 126 or 128 is straight. In an alternative embodiment, side edge 126 or 128 has a plurality of tabs, 130*a-c* or 132*a-c*, such as depicted in FIG. 7. Although FIG. 7 depicts side edges 126, 128 having three tabs 130*a-c*, 132*a-c* apiece, side edges 126, 128 may have any numbers of tabs 130, 132. Tabs 130, 132 may be the same or different in shape. In an embodiment, tabs 130, 132 are the same shape and substantially square, as depicted in FIGS. 6-7. Lift plate 110 may also have motor-mounting apertures 134 and actuator-mounting apertures 135.

Figure 18:
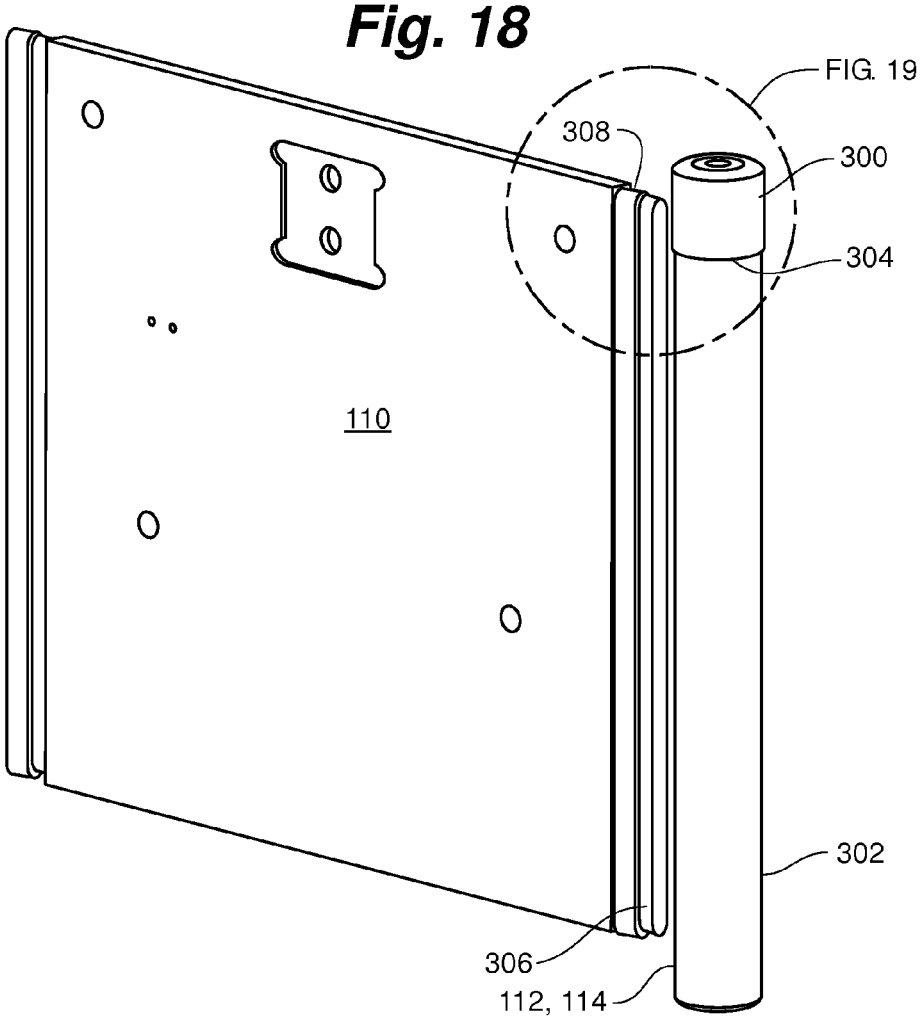
FIG. 18 is a perspective view of a lift plate and a bearing of a motor lift according to an embodiment of the present invention.
Figure 19:
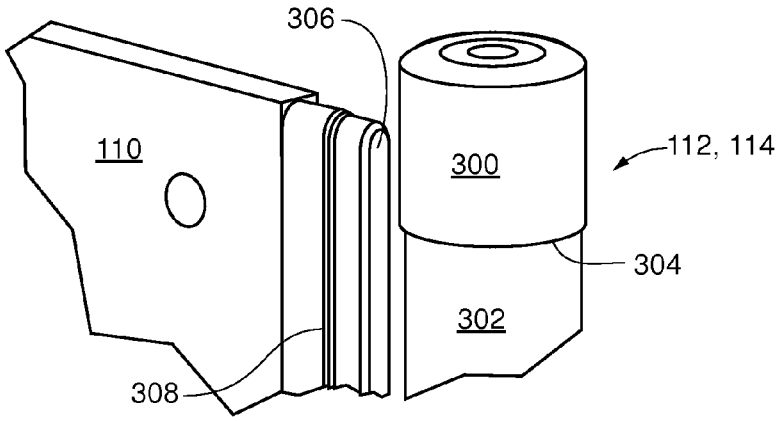
FIG. 19 is an enhanced perspective view of a portion of the lift plate and the bearing depicted in FIG. 18.
Figure 26:
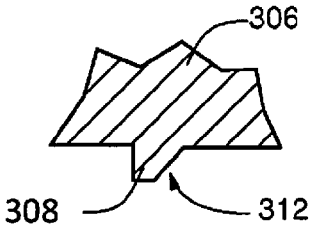
FIG. 26 is an enhanced cross-sectional top view of a portion of the motor lift according to the embodiment of the present invention depicted in FIG. 24.

In an embodiment, side edges 126, 128 of lift plate 110 may have tongue 306, as depicted in FIGS. 18-19. Tongue 306 may also have ridge 308. Ridge 308 may follow the entire outer perimeter of tongue 306, as depicted in FIGS. 18-19. Alternatively, ridge 308 may be present on only a portion of the surface of tongue 306. For example, ridge 308 may be present only on the sides of tongue 306. Ridge 308 may also be present only on the top and/or bottom surface of tongue 306. In an embodiment, ridge 308 has canted edge 312, as depicted in FIG. 26.

Each bearing 112, 114 generally have outer surface 140, top surface 142, and bottom surface 144. Each bearing 112 or 114 may have chamfered edge 146 between top surface 142 and bottom surface 144. Each bearing 112 or 114 defines slot 145. Slot 145 extends partially along length of bearing 112 or 114 to form lip 147, as depicted in FIGS. 8-11. In an embodiment, slot 145 forms lip 147 below top surface 142 and above bottom surface 144. In alternative embodiments, slot 145 forms lip 147 below top surface 142 or above bottom surface 144.

In an embodiment, each bearing 112, 114 may also have upper portion 300 and lower portion 302, as depicted in FIGS. 18-19. Upper portion 300 and lower portion 302 are generally similar in shape, but may have different dimensions. The respective shapes of upper and lower portions 300, 302 may, however, also be different without departing from the spirit or scope of the present invention.

Figure 24:
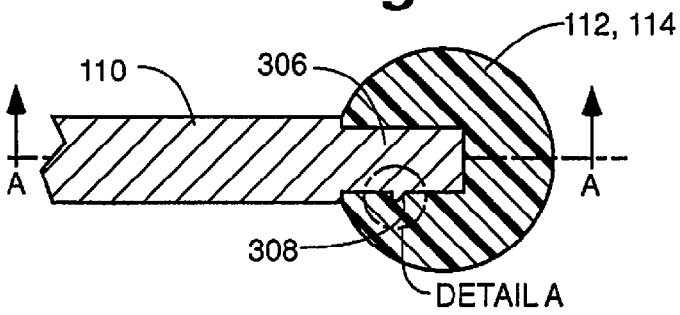
FIG. 24 is a partial cross-sectional top view of a motor lift according to an embodiment of the present invention.
Figure 25:
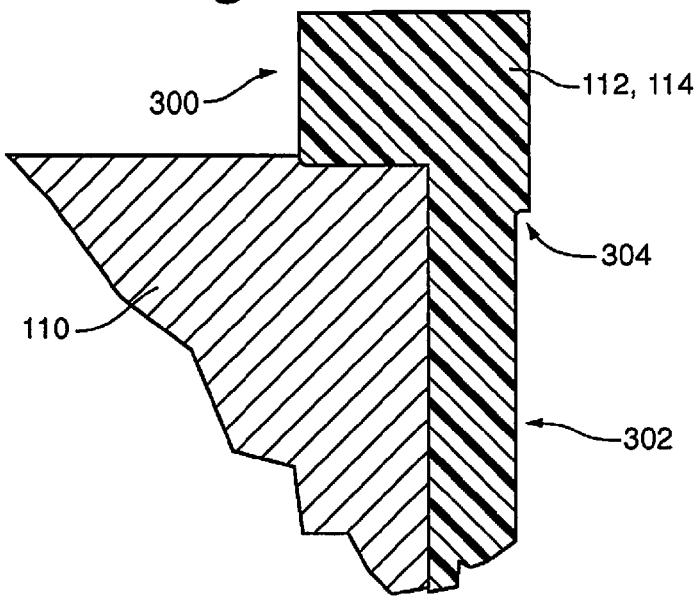
FIG. 25 is a partial cross-sectional front view at line A-A of the motor lift of the present invention depicted in FIG. 24.
Figure 27:
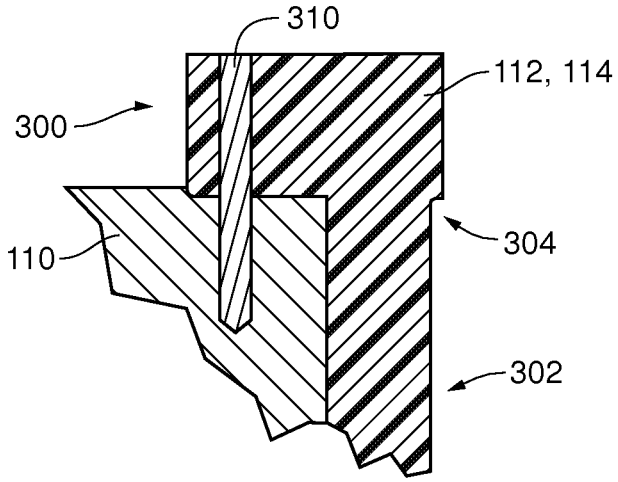
FIG. 27 is a cross-sectional front view of a motor lift according to an embodiment of the present invention.

Referring to FIGS. 18-19, upper and lower portions 300, 302 are generally cylindrical in shape. In an embodiment, upper portion 300 has a larger diameter than lower portion 302. In this manner, each bearing 112, 114 presents ledge 304, as depicted in FIGS. 24 and 27. One skilled in the art will readily recognize that either one or both bearings 112, 114 may be adapted to have ledge 304 without departing from the spirit or scope of the present invention.

Figure 10:
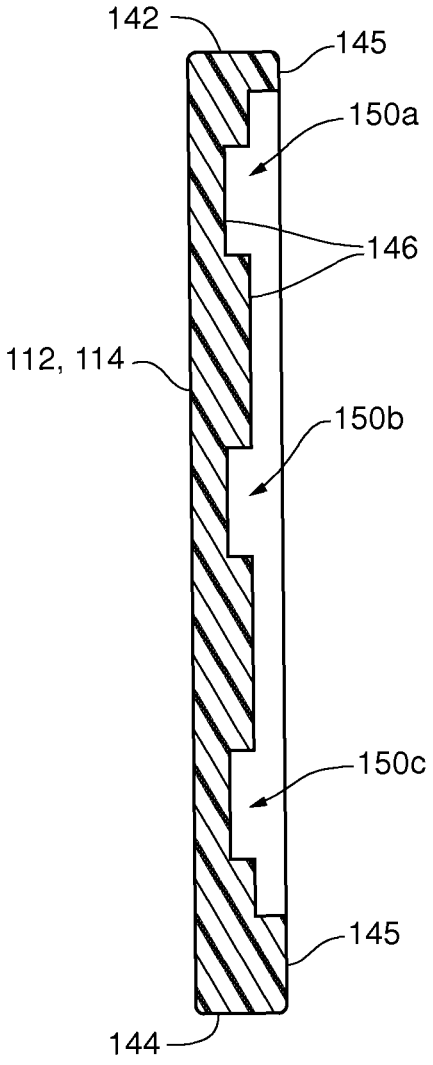
FIG. 10 is a cross-sectional view of a bearing according to another embodiment of the present invention.
Figure 11:
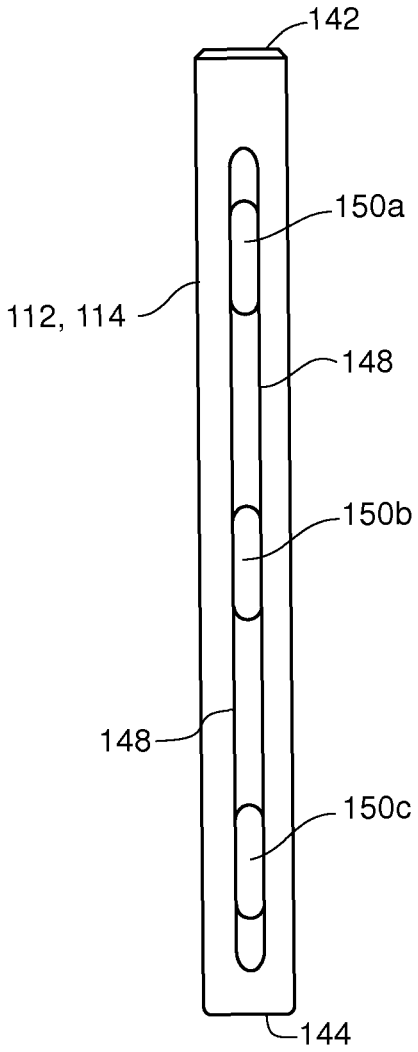
FIG. 11 is a cross-sectional view of a bearing according to the embodiment of the invention depicted in FIG. 10.

Slot 145 has inner edge 146 and side edges 148. Inner edge 146 of slot 145 and side edges 126, 128 of lift plate 110 generally have complementary geometries. For example, inner edge 146 can define grooves 150. Although grooves 150 can be any number of sizes and shapes, grooves 150 are generally adapted to conformingly receive tabs 130 or 132 of lift plate 110. In an embodiment, each bearing 112 or 114 has a plurality of grooves 150*a-c*, such as depicted in FIGS. 10-11. In another embodiment, each bearing 112 or 114 has a single groove 150*a*. Although the embodiments depicted in FIGS. 8-11 have slot 145 that only partially runs the length of bearing 112 or 114, one skilled in the art will readily recognize that inner edge 146 can define grooves 150 within slot 145 running the entire length of bearing 112 or 114 without departing from the spirit or scope of the present invention.

Figure 21:
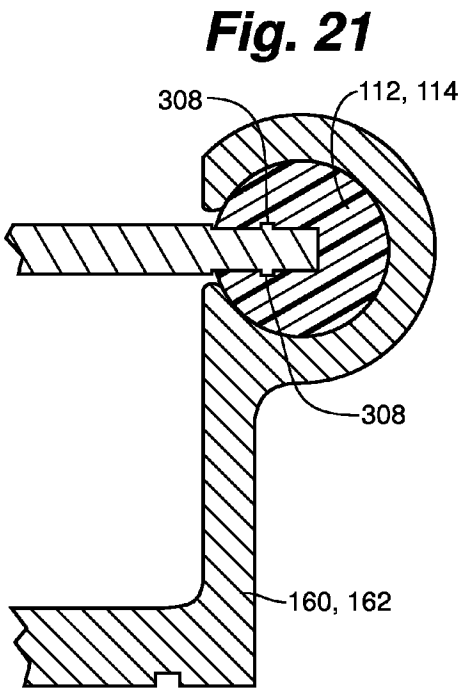
FIG. 21 a partial cross-sectional top view of a motor lift and a spacing bracket according to an embodiment of the present invention.
Figure 23:
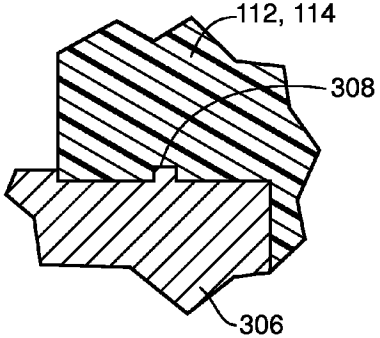
FIG. 23 is an enhanced cross-sectional front view of a portion of the motor lift according to the embodiment of the invention depicted in FIG. 21.
Figure 20:
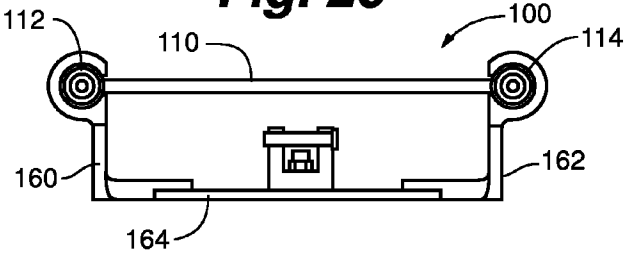
FIG. 20 is a top view of a motor lift according to an embodiment of the present invention.
Figure 22:
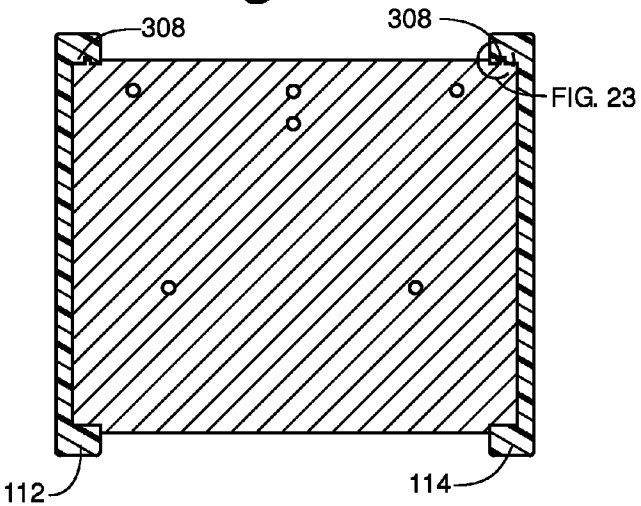
FIG. 22 is a cross-sectional front view of a motor lift according to the embodiment of the invention depicted in FIG. 21.

In an embodiment, slot 145 is adapted to receive tongue 306. Generally, depth of channel 144 is sufficient to accommodate all of tongue 306. Slot 145 may also be adapted to receive tongue 306 having ridge 308, as depicted in FIGS. 21-23. Bearings 112, 114 are thereby able to accommodate lift plate 110 having ridges 308 on either or both sides of tongue 306, as depicted in FIG. 21. Bearings 112, 114 are also able to accommodate lift plate 110 having ridge 308 on the top of tongue 306, as depicted in FIGS. 22-23. Though not shown, bearings 112, 114 are similarly able to accommodate lift plate 110 having ridge 308 on the bottom of tongue 306. One skilled in the art will further recognize that channels 144 of bearings 112, 114 can be adapted to receive any number of combinations of tongues 306 and/or tabs 130, 132 without departing from the spirit of scope of the present invention.

Jack plate mounting assembly 104 comprises spacing brackets, 160, 162 and transom plate 164, as depicted in FIGS. 12-15. Jack plate mounting assembly 104 can also include actuator mount 165. Spacing brackets 160, 162 are generally mirror images. Each spacing bracket 160 or 162 has jack plate rail 166, side wall 168, and transom wall 170. A portion of Jack plate rail 166 defines C-shaped channel 172 and presents top surface 174. C-shaped channel 172 is substantially cylindrical and has slit 176. Slit 176 extends the length of jack plate rail 166. Generally, the width of slit 176 corresponds with the width of lift plate 110.

In an embodiment, C-shaped channel 172 also has a radius substantially similar to the radius of bearings 112, 114 such that bearing 112 or 114 can conformingly fit within jack plate rail 166. In another embodiment, C-shaped channel 172 has a radius that is substantially similar to the radius of lower portion 302 of bearing 112, 114 but smaller than the radius of upper portion 300 of bearing 112, 114. In accordance with this embodiment, lower portion 302 of bearing 112, 114 can fit within C-shaped channel 172, but upper portion 300 cannot. Ledge 304 that is created by the difference in radii between upper and lower portions 300, 302 thereby substantially prevents bearings 112, 114 of motor lift 102 from passing completely through C-shaped channels 172 in a downward direction.

Figure 13:
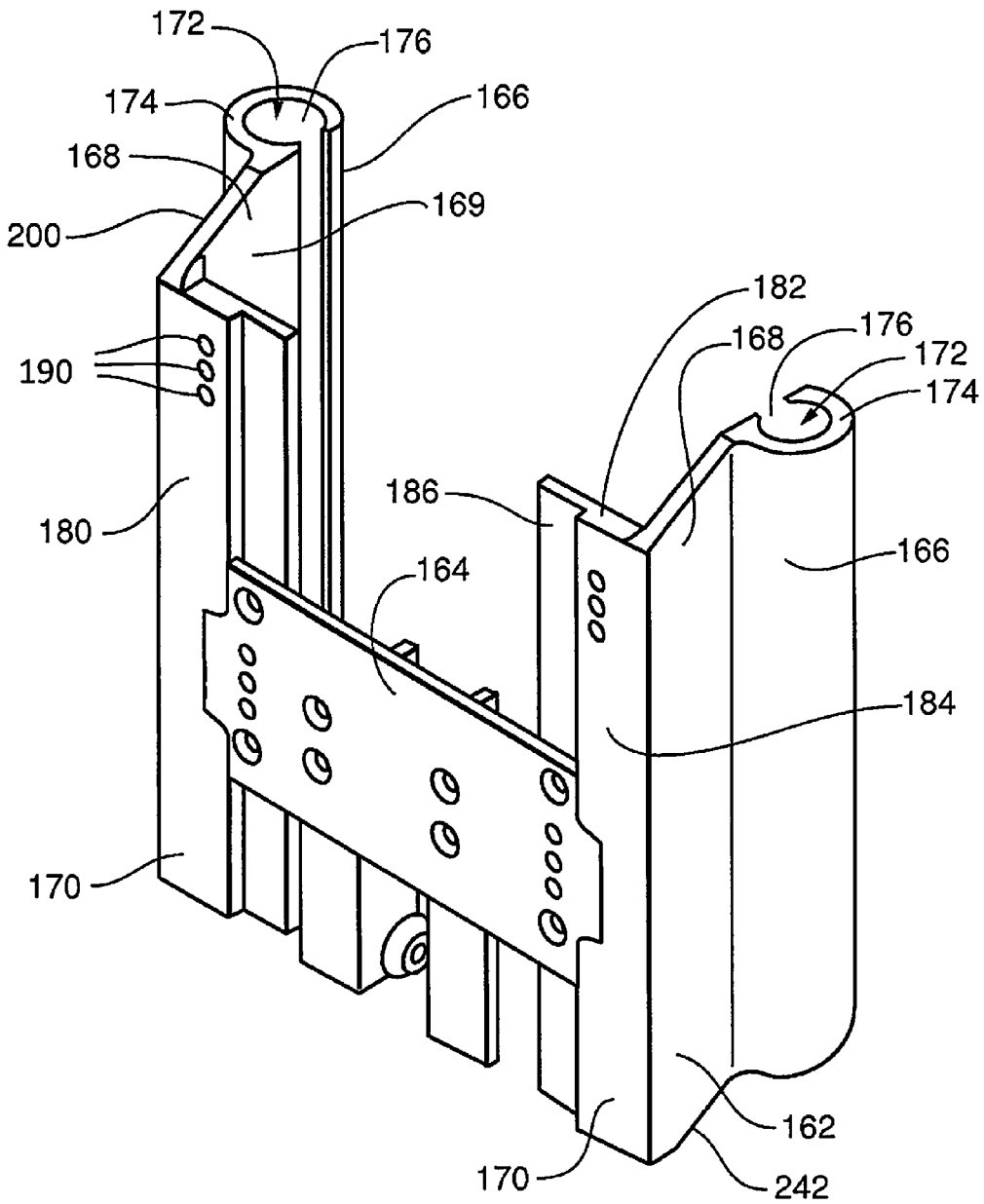
FIG. 13 is perspective view of a jack plate mounting assembly according to the embodiment of the present invention depicted in FIG. 12.
Figure 14:
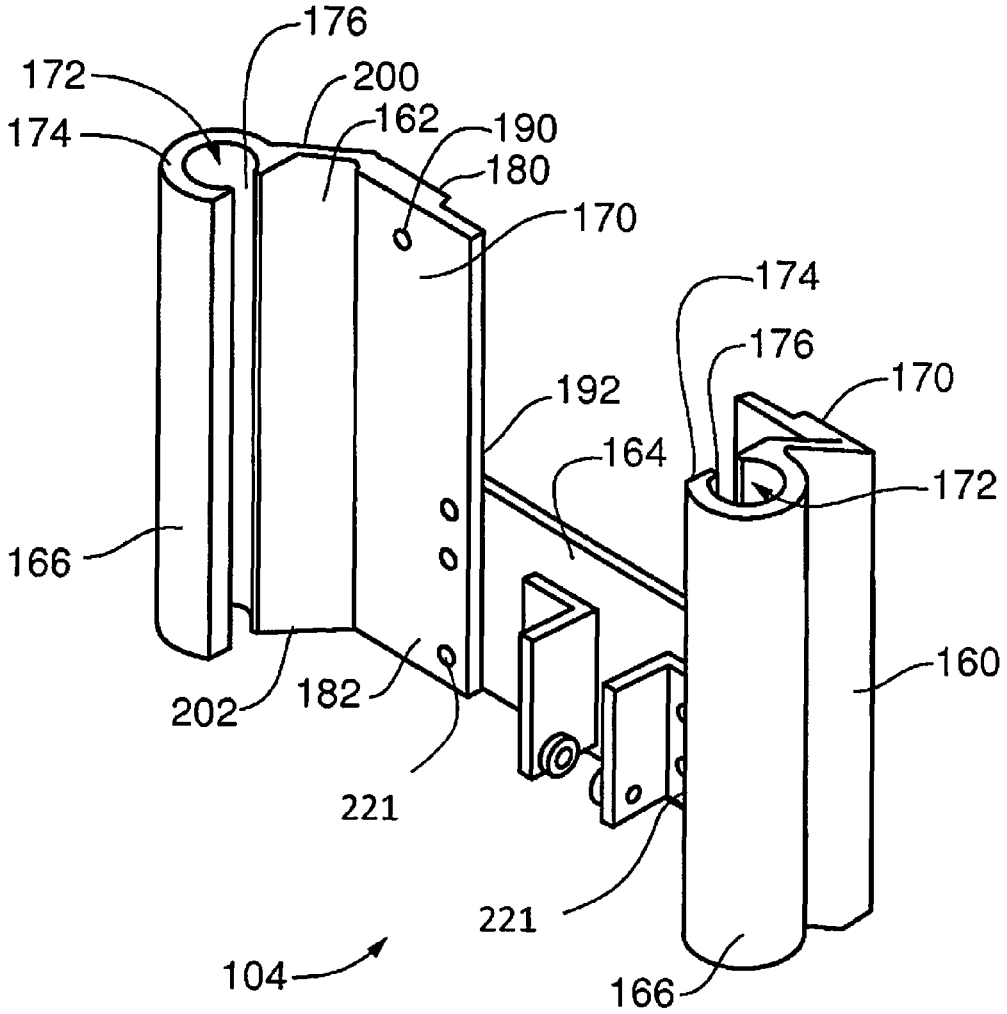
FIG. 14 is another perspective view of a jack plate mounting assembly according to the embodiment of the present invention depicted in FIG. 12.
Figure 15:
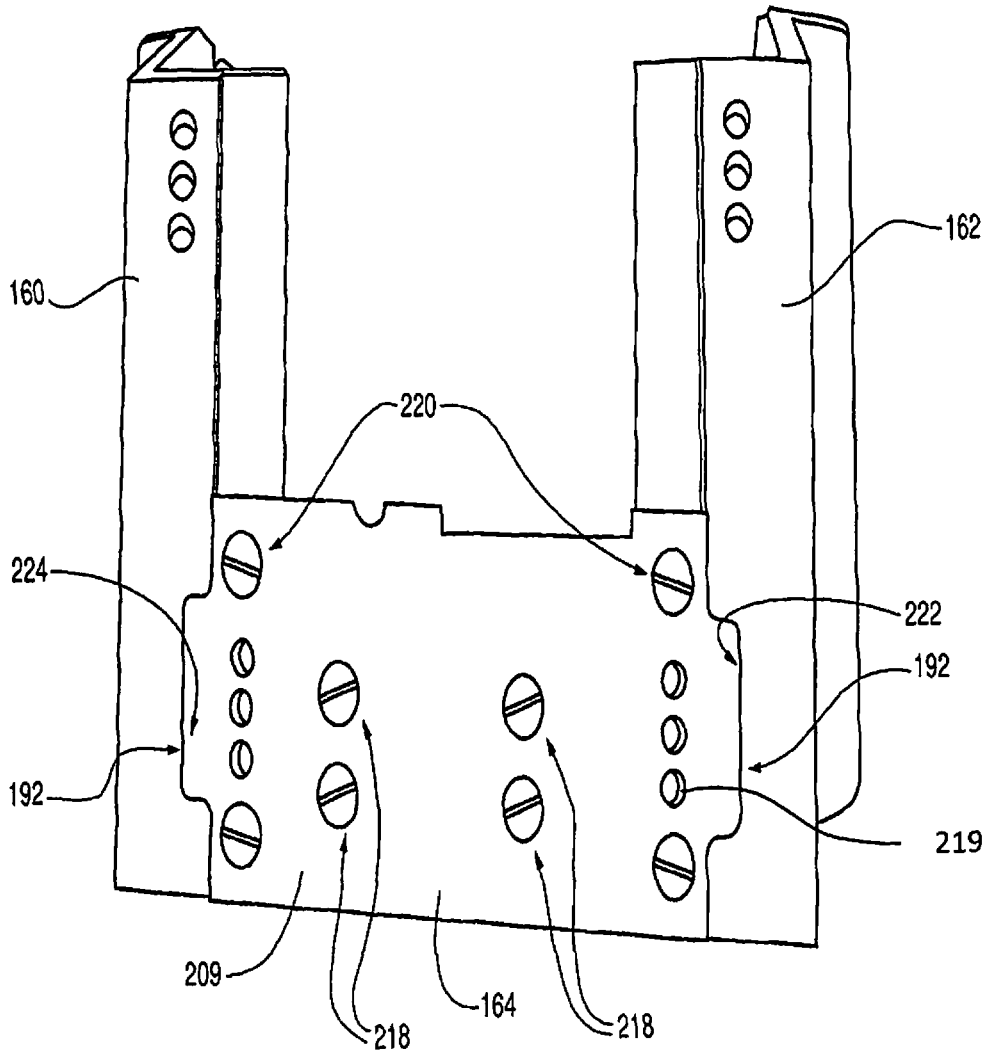
FIG. 15 is a perspective view of a jack plate mounting assembly according to an embodiment of the present invention.

Transom wall 170 has front side 180 and rear side 182. Front side 180 can have elevated region 184 and recessed region 186. Elevated region 184 and recessed region 186 generally define parallel planes, as depicted in FIGS. 13-14, such that elevated region 184 and recessed region 186 are set apart. In an embodiment, recessed region 186 extends into elevated region 184 to form inlet 192, as depicted in FIG. 15. Inlet 192 can receive a portion of transom plate 164. Transom wall 170 has transom-mounting apertures 190 and bracket-mounting apertures 221. Referring to FIGS. 13-14, transom-mounting apertures 190 extend through elevated region 184 and bracket-mounting apertures 221 extend through recessed region 186 in an embodiment.

Extending between jack plate rail 166 and transom wall 170 is side wall 168. Side wall 168 defines top edge 200 and bottom edge 202. Side wall 168 can be slanted upward from transom wall to top surface 174 of jack plate rail 166, as depicted in FIGS. 13-14. The angles of incline of top and bottom edges 200, 202 can be the same or different and are between approximately zero degrees and forty-five degrees. Generally, the angles of incline of top and bottom edges 200, 202 are substantially similar to the angle of decline of the transom on which jack plate 100 is mounted. In an embodiment, the angles of incline of top and bottom edges 200, 202 are the same and are approximately twelve degrees. In another embodiment, the angle of incline of top edge 200 is thirty-five degrees and the angle of incline of bottom edge 202 is thirty degrees.

Figure 16:
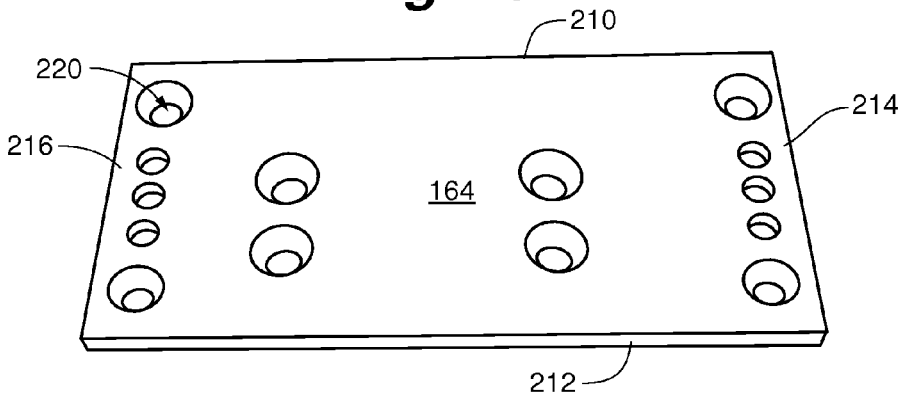
FIG. 16 is a perspective view of a transom plate according to an embodiment of the present invention.
Figure 17:
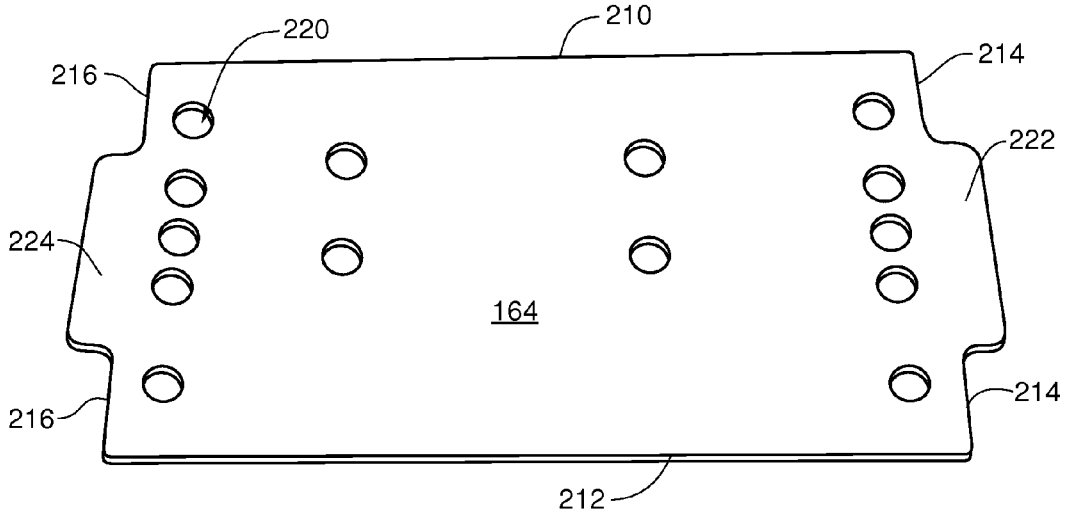
FIG. 17 is a perspective view of a transom plate according to an embodiment of the present invention.

Referring to FIGS. 15-17, transom plate 164 has transom-interfacing surface 209, top edge 210, bottom edge 212, side edges 214, 216, and back surface 217. Transom plate 164 also has a plurality of actuator-mounting apertures 218, transom-mounting apertures 219, and spacing bracket-mounting apertures 220. In an embodiment, side edges 214, 216 have retaining flanges 222, 224, as depicted in FIGS. 16-17. Retaining flanges 222, 224 may be the same or different in shape. Generally, retaining flanges 222, 224 are the same shape and substantially rectangular, as depicted in FIGS. 16-17. In addition, retaining flanges 222, 224 are adapted to conformingly fit within inlets 192 of transom wall 170. In an alternative embodiment, side edges 214, 216 do not have retaining flanges 222, 224. Although FIGS. 16-18 depict transom plates 164 having only two retaining flanges 222, 224 or no retaining flanges 222, 224, one skilled in the art will readily recognize that side edges 214, 216 of transom plate 164 can have any number of retaining flanges 222, 224 in any number or shapes that would fit within inlets 192 of transom wall 170 without departing from the spirit or scope of the present invention.

Figure 12:
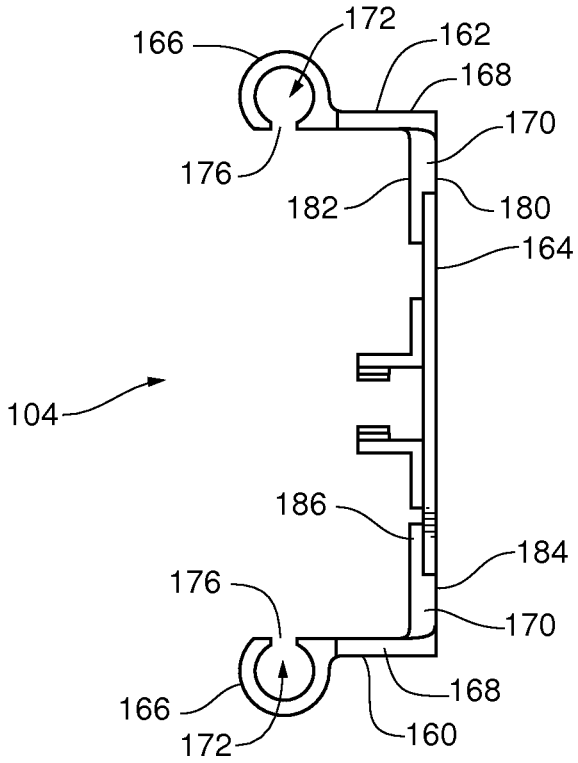
FIG. 12 is a top view of a jack plate mounting assembly according to an embodiment of the present invention.

Transom plate 164 may have actuator mount 165 attached to back surface 217. Actuator mount 165 can be formed from two actuator brackets 230, 232, as depicted in FIGS. 12-14. In alternative embodiments, actuator mount 165 may be formed from a single actuator bracket or from an actuator mount assembly having a several actuator brackets and/or additional components.

The various components of jack plate 100 can be made from any number of materials. Generally, lift plate 110, spacing brackets 160, 162, and transom plate 164 are made from a metallic material such as, for example, steel or aluminum. Although bearings 112, 114 can also be from any number of materials, bearings 112, 114 are generally made from a low-friction polymer. Although the polymer material from which bearings 112, 114 are made may be rigid, it is generally at least slightly elastic. For example, some degree of elasticity may be necessary for bearings 112, 114 to receive and retain lift plate 110 having tongue 306 with ridge 308. In an embodiment, lift plate 110, spacing brackets 160, 162, and transom plate 164 are made from steel and bearings 112, 114 are made from ultra-high molecular weight polyurethane.

Referring to FIG. 1, in constructing jack plate 100, transom plate 164 is attached to spacing brackets 160, 162. Transom plate 164 is positioned on recessed region 186 such that transom-interfacing surface 209 and the surface of front side 180 of transom wall 170 are substantially co-planar and spacing bracket-mounting apertures 220 of transom plate 164 are aligned with bracket-mounting apertures 221 of transom wall 170. In an embodiment, retaining flanges 222, 224 are also positioned within inlets 192 of transom wall 170. The distance between jack plate rails 166 can be varied by changing the dimensions of transom plate 164. Transom plate 164 can be secured to spacing brackets 160, 162 by inserting fastening members through spacing bracket-mounting apertures 220 and bracket-mounting apertures 221.

Side edges 126, 128 of lift plate 110 are inserted into channels 144 of bearings 112, 114. Within channels, tabs 130, 132 of lift plate 110 are aligned with grooves 150 of inner edges 146 of bearings 112, 114. In an embodiment, lift plate 110 is situated between lips 147 formed by slot 145 in each bearing 112, 114. Fastening members 310 can also be secured through lift plate 110 and bearings 112, 114.

In an embodiment, bearings 112, 114 can retain lift plate 110 without the use of fastening members 310. For example, lift plate 110 having tongue 306 with ridges 308 can be inserted into bearings 112, 114. Generally, the distance between ridges 308 on opposite sides of tongue 306 is slightly greater than the corresponding width of slot 145. Ridge 308 can therefore engage grooves 130, 132 within slot 145 of bearing 112, 114. In this manner, bearings 112, 114 substantially conform around tongue 306 and ridge 308 of lift plate 110.

The inherent elasticity of the material from which bearings 112, 114 are made permit insertion and retention of ridged tongue 306. In an embodiment, slot 145 can become wider as forced is applied to lift plate 110. Tapered edge 312 of ridge 308 may facilitate insertion of ridged tongue 306 by gradually urging slot 145 to become wider. In another embodiment, bearings 112, 114 can be heated to facilitate insertion of ridged tongue 306. By elevating the temperature of bearings, the bearing material may become more pliable, thereby facilitating elastic deformation. In addition, heating the material may cause expansion of the material, thereby widening the opening in order to accommodate insertion of ridged tongue 306. As the material subsequently cools, bearings 112, 114 are able to retain ridged tongue 306 within slot 145. In particular, the material can become more rigid and generally contract, thereby creating a conforming fit between bearings 112, 114 and ridged tongue 306 of lift plate 110.

To further secure lift plate 110 between bearings 112, 114, fastening member 310 can also be used. Referring to FIG. 27, fastening member 310 can be inserted into bearing 112, 114 and lift plate 110. Although the embodiment depicted in FIG. 27 shows fastening member 310 as having entered bearing 112, 114 through top surface 142, fastening member 310 may also enter bearing 112, 114 through bottom surface 144 or outer surface 140. In an embodiment, fastening member is countersunk within bearing 112, 114.

Motor lift 102 is positioned within jack plate mounting assembly 102 by inserting bearings 112, 114 into jack plate rails 166. In an embodiment, a lubricant is also added to bearings 112, 114 or jack plate rails 166. By inserting bearings 112, 114 into jack plate rails 166, motor lift 102 is pressure fit within spacing brackets 160, 162 of jack plate mounting assembly 104.

Actuator 106 is generally attached to motor lift 102 and jack plate mounting assembly 104. Referring to FIG. 1, actuator 106 is attached to actuator mount 116 of motor lift and actuator mount 165 of jack plate mounting assembly 104. Actuator 106 is operably connected to power source (not shown). In an embodiment, power source provides hydraulic power. In alternative embodiments, power source 230 provides electrical or manually-derived power.

To install jack plate 100, transom plate 164 is attached to the transom of boat 50 and lift plate 110 is attached to an outboard motor 60, as depicted in FIG. 5. Fastening members are inserted through transom-mounting apertures 190, 219 of spacing brackets 160, 162 and transom plate 164. Fastening members are also inserted through motor-mounting apertures 134 of lift plate 110.

In operation, jack plate 100 raises and lowers the depth of motor 60 within the water through the manipulation of controls operably connected to actuator 106, such as, for example, to adjust the trim of boat 50 within a body of water. Generally, jack plate 100 is mounted to the transom of boat 50. Since jack plate mounting assembly 104 is fixedly attached to boat 50, movement of actuator 106 causes a corresponding movement of motor lift 102. Therefore, as actuator 106 is extended, motor lift 102 rises in relation to jack plate mounting assembly 104, causing motor 60 to be raised toward the surface of the water. Similarly, as actuator 106 is retracted, motor lift 102 descends in relation to jack plate mounting assembly 104, causing motor 60 to be lowered further below the surface of the water.

Figure 2A:
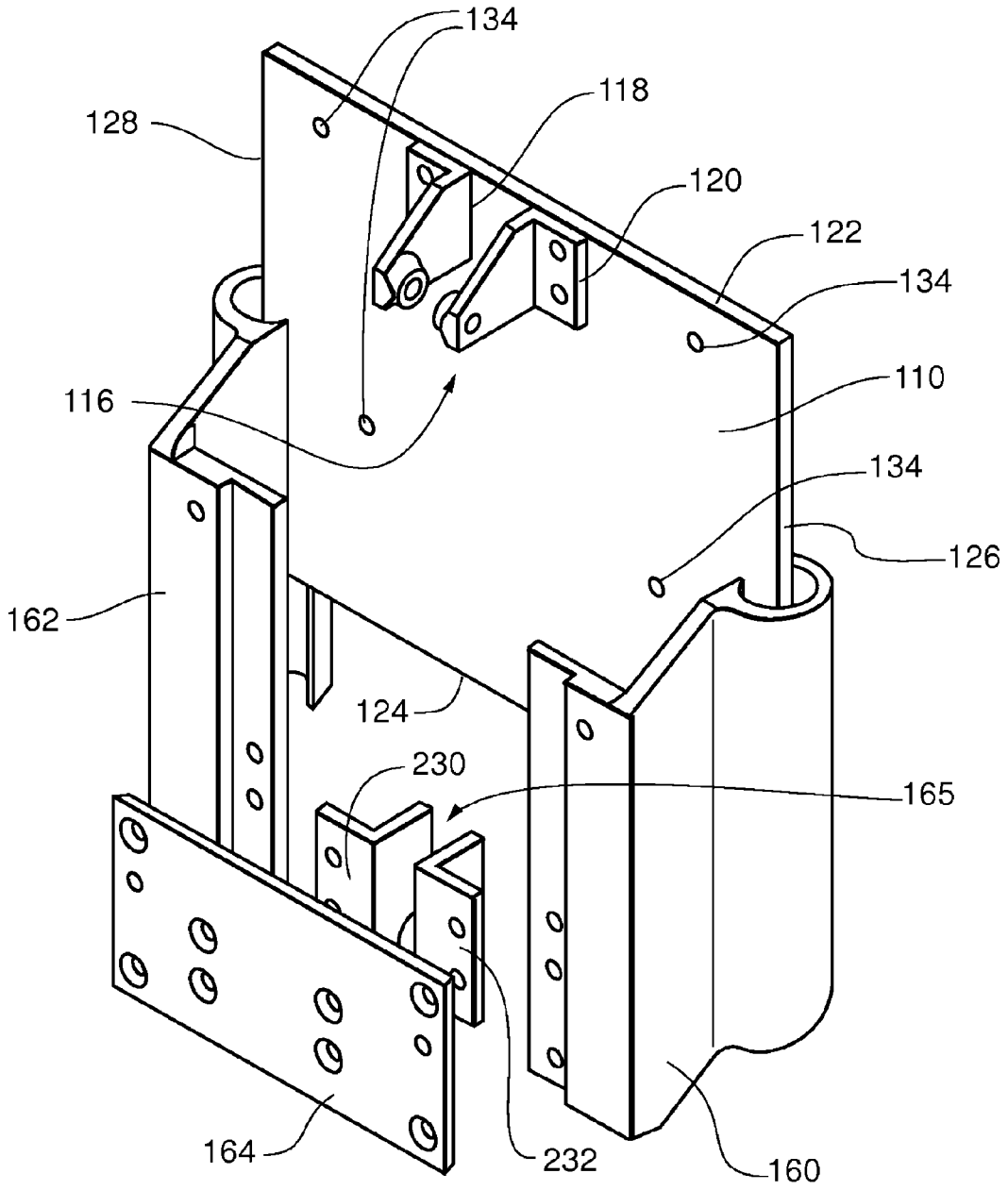
FIG. 2A is a partially exploded perspective view of a jack plate according to an embodiment of the present invention without bearings.
Figure 2B:
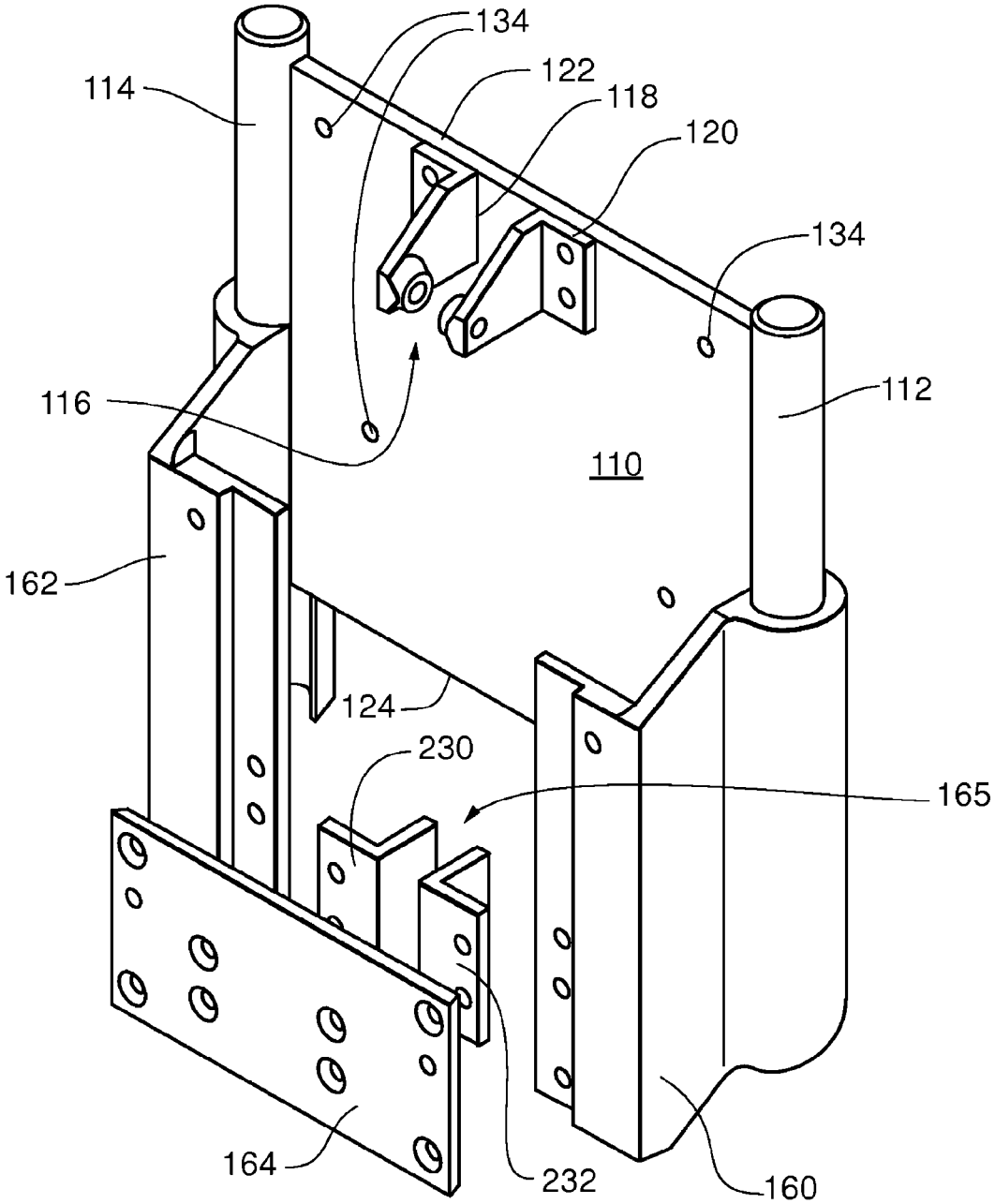
FIG. 2B is a partially exploded perspective view of a jack plate according to an embodiment of the present invention.
Figure 3:
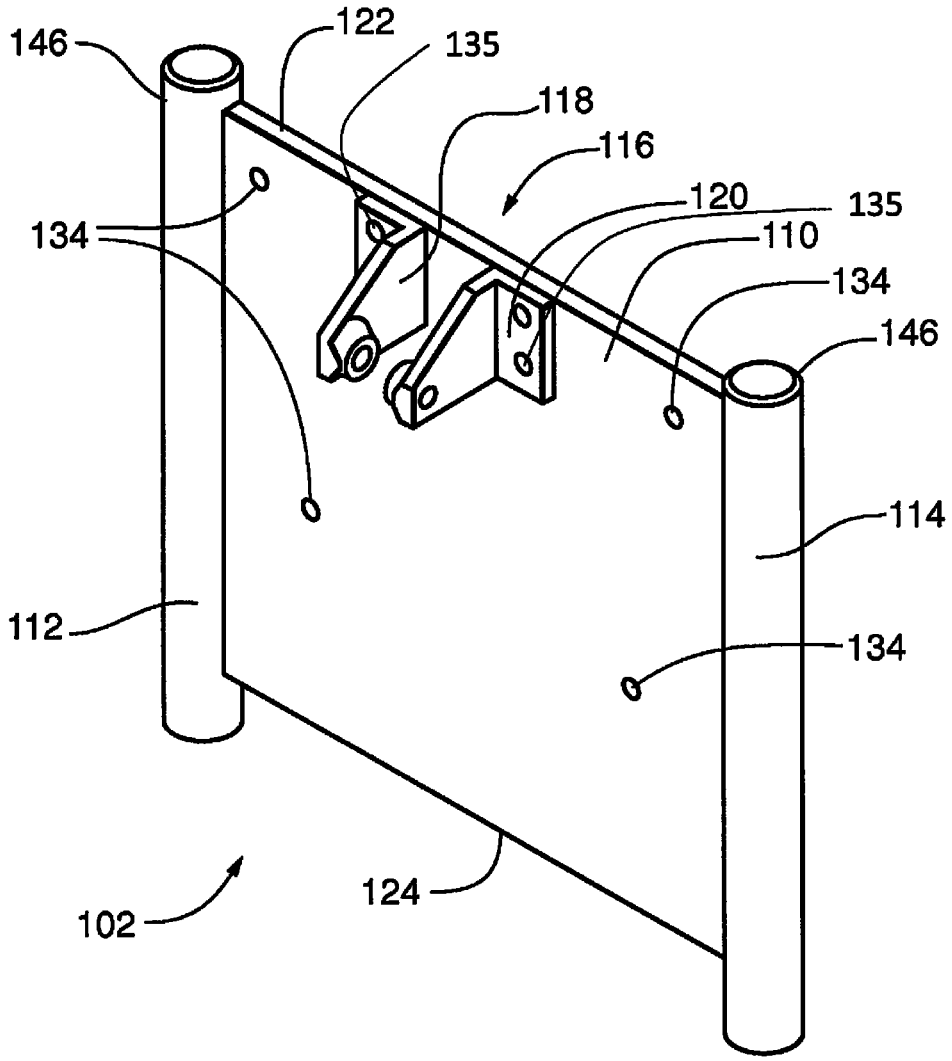
FIG. 3 is a perspective view of a motor lift according to an embodiment of the present invention.
Figure 4:
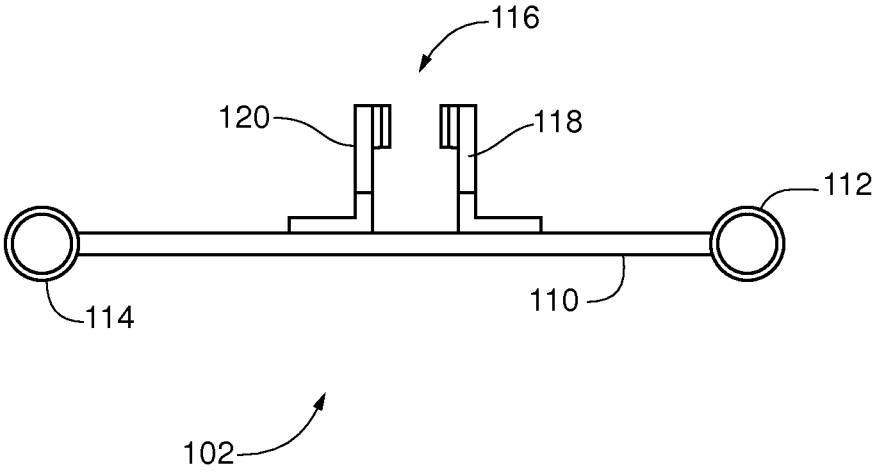
FIG. 4 is a top view of a motor lift according to an embodiment of the present invention.

Jack plate 100 also provides safety features to guard against loss of motor 60 during operation. For example, it is possible that actuator 106 or actuator brackets 118, 120 could fail. As a result of such failure, the weight of motor 60 and/or the drag produced by a moving boat 50 may force downward. If such downward movement of motor is not sufficiently inhibited, bearings 112, 114 of motor lift 102 may pass completely through C-shaped channels 172, causing motor 60 to fall from boat 50, such as, for example, to the bottom of a body of water. Such loss may be prevented, however, by the presence of ledge 304 on bearings 112, 114. If actuator 106 or actuator brackets 118, 120 fail during operation, for example, ledge 304 formed by upper portion 300 presents a surface that will contact top surface 142 of spacing brackets, 160, 162. In that manner, motor lift 102, as well as motor 60 attached to motor lift 102, can be prevented from disengaging from jack plate mounting assembly 104. If only actuator 106 fails, actuator brackets 118, 120, 230, 232 also can prevent loss of motor 60. In particular, actuator brackets 118, 120 of actuator mount 116 and actuator brackets 230, 232 of actor mount 165 are generally overlapping, as depicted in FIG. 2A-2B. Therefore, in the event of actuator 106 failure causing lift plate 110 and motor 60 to descend, actuator mount 165 interferes with actuator mount 116 such that motor lift 102 cannot pass completely through C-shaped channels 172.

A feature and advantage of the present invention is the ability of jack plate 100 to resist failure or malfunction due to torque. During raising or lowering of motor 60, as well as during operation of boat 50 when motor 60 is stationary relative to jack plate 100, such as, for example, during turning of boat 50, various components of jack plate 100 are subject to torque. In existing jack plates, such torque can cause slight movement among the various components. Jack plate 100 of the present invention can reduce or eliminate such movement. In particular, the union of lift plate 110 and bearings 112, 114 does not require fastening member 310 in accordance with some embodiments. Therefore, the torque and vibrations resulting from operation or motor and jack plate 100 can eliminate the possibility of fastening member 310 fully or partially disengaging, thereby reducing the likelihood of binding occurring between bearings 112, 114 and spacing brackets 160, 162.

Torque can also cause spacing brackets 160, 162 to move relative to each other. This movement can result is spacing brackets 160, 162 being forced closer together or farther apart. When spacing brackets 160, 162 are forced farther apart, bearings 112, 114 may be urged to separate from lift plate 110. By engaging ridges 308 on tongues 306 with appropriately configured slots 145 within bearings 112, 114, the tendency of spacing brackets 160, 162 to separate can be resisted. Retaining flanges 222, 224 of transom plate 164 can also reduce relative movement between spacing brackets 160, 162.

The invention claimed is:

1. A jack plate comprising: a mounting assembly having first and second spacing brackets connected by a transom plate, each of the first and second spacing brackets having a forward side and a rearward side, each of the spacing brackets having parallel inwardly facing channels at the rearward sides, each of the spacing brackets having a recessed region for receiving the transom plate, the transom plate having a pair of opposing sides and four exterior corners, when the transom plate is viewed from the front, a first pair of the four exterior corners is engaged with the first spacing bracket on the recessed region of said first spacing bracket and a second pair of the four exterior corners is engaged with the second spacing bracket on the recessed region of said second spacing bracket; a motor lift including a lift plate extending between a first bearing and a second bearing, each bearing having a slot to receive a side of the lift plate; and wherein the channels are adapted to conformingly receive the first and second bearings.

2. The jack plate of claim 1, wherein each of the recessed regions is forwardly facing.

3. The jack plate of claim 1, wherein the first and second spacing brackets are adapted to removably receive the transom plate in a forward direction and retain the transom plate in directions perpendicular to the forward direction.

4. The jack plate of claim 1, wherein each recessed region of the spacing brackets has an centrally positioned recessed inlet that receives a tab extending from a respective side of the transom plate.

5. The jack plate of claim 1, wherein the lift plate substantially defines a plane, and each side of the lift plate has at least one protrusion and the one protrusion is engaged in a conforming portion of the respective bearing slot.

6. The jack plate of claim 1, wherein the motor lift further includes a fastening member extending through one of the first bearing and the second bearing and the lift plate.

7. The jack plate of claim 1, wherein at least one of the first or second bearings and at least one of the first or second spacing brackets present opposing surfaces adapted to prevent the motor lift from disengaging the first and second spacing brackets in a downward direction.

8. The jack plate of claim 1, wherein each bearing has a shoulder stop.

9. The jack plate of claim 1, wherein the first and second bearings are made from a polymer.

10. A jack plate comprising: a mounting assembly having first and second spacing brackets connected by a transom plate, each of the first and second spacing brackets having a forward side and a rearward side, each of the spacing brackets having parallel inwardly facing channels at the rearward sides; a motor lift including a lift plate extending between a first bearing and a second bearing, each bearing having a slot to receive a side of the lift plate; and wherein the channels each have a cross-sectional radius and are adapted to conformingly receive the first and second bearings, each of the bearings formed of a polymer and having a widened portion at a top of the bearing, the widened portion having a cross-sectional radius greater than the cross-sectional radius of the channels, providing a stop preventing the top of the bearing from entering the respective channel.

11. The jack plate of claim 10, wherein the bearings are substantially cylindrical.

12. The jack plate of claim 10, wherein each of the channels have a C-shaped cross-section.

13. A boat comprising: a hull having a transom; an outboard motor; a jack plate disposed intermediate the hull and the outboard motor, the jack plate further comprising: a mounting assembly having first and second spacing brackets connected by a transom plate, each of the first and second spacing brackets defining parallel channels distal to the transom plate, the transom plate being mountable to a boat transom; a motor lift including a lift plate positionable intermediate first and second bearings, each bearing defining a slot adapted to receive a first or second side of the lift plate; an actuator operably connected to the mounting assembly and the motor lift; and wherein the channels are adapted to conformingly receive the first and second bearings, each bearing having an integral stop sized to prevent the stop from entering the respective channels.

14. The boat of claim 13, wherein the channels and the bearings are substantially cylindrical.

15. The jack plate of claim 14, wherein a portion of the first spacing bracket and a portion of the second spacing bracket each define parallel channels, each portion of the first and second spacing bracket having a substantially C-shaped cross-section.

16. The boat of claim 13, wherein the slot of the first or second bearing defines at least one inset groove and the first or second side of the lift plate defines at least one protrusion, the at least one inset groove being complementary to the at least one the protrusion.

17. The boat of claim 16, wherein the lift plate substantially defines a plane, the at least one protrusion extending from the first or second side in a direction substantially parallel to the plane.

* * * * *